US010513865B2

(12) United States Patent
Petrenko

(10) Patent No.: US 10,513,865 B2
(45) Date of Patent: Dec. 24, 2019

(54) LATCHING MECHANISM FOR RETRACTABLE SHELTERS

(71) Applicant: Ihor Petrenko, Phoenix, AZ (US)

(72) Inventor: Ihor Petrenko, Phoenix, AZ (US)

( * ) Notice: Subject to any disclaimer, the term of this patent is extended or adjusted under 35 U.S.C. 154(b) by 0 days.

(21) Appl. No.: 16/164,690

(22) Filed: Oct. 18, 2018

(65) Prior Publication Data

US 2019/0048609 A1 Feb. 14, 2019

Related U.S. Application Data

(63) Continuation-in-part of application No. 16/001,675, filed on Jun. 6, 2018, which is a continuation of (Continued)

(51) Int. Cl.
*E04H 15/38* (2006.01)
*E04H 6/04* (2006.01)
(Continued)

(52) U.S. Cl.
CPC ..... *E04H 6/04* (2013.01); *E04H 6/025* (2013.01); *E04H 15/38* (2013.01); *E04H 15/46* (2013.01); *E04H 15/48* (2013.01); *E04H 15/54* (2013.01)

(58) Field of Classification Search
CPC ..... E04H 15/02; E04H 15/36; E04H 15/38; E04H 15/54; E04H 15/46; E04H 15/58; E04H 6/02; E04H 6/04; E04H 6/005; B60P 3/40; B60P 7/02
USPC ..... 135/88.13, 88.15, 124, 129, 132–133, 135/136–137, 905, 912; 296/100.12, 296/100.18, 105, 109, 163; 52/66–67
See application file for complete search history.

(56) References Cited

U.S. PATENT DOCUMENTS 2,755,811 A 7/1956 Murray
2,817,344 A 12/1957 Teeter
(Continued)

FOREIGN PATENT DOCUMENTS

FR 2286037 A1 4/1976
JP 06002447 A * 1/1994 ..... E04H 6/04

OTHER PUBLICATIONS

PCT; International Search Report and Written Opinion dated Sep. 7, 2016 in the International Application No. PCT/US2016/37058.
(Continued)

*Primary Examiner* — Winnie Yip
(74) *Attorney, Agent, or Firm* — Snell & Wilmer L.L.P.

(57) ABSTRACT

A shelter for an automobile has a pair of tracks positioned on opposing sides of the automobile and rest on a supporting surface such as the floor of a garage or car-port. A plurality of frames each having a u-shaped contour extend on opposing sides and over the automobile and are spaced apart from it. The terminal ends the frames are engaged with trucks which are in rolling engagement with the tracks. A canopy of a flexible material is attached over the frames and is movable between a folded state and an unfolded state when the trucks are moved within the tracks. The tracks have mutually orthogonal roller contact surfaces and the trucks have mutually orthogonal rollers positioned for rolling on the roller contact surfaces of said tracks. The canopy is able to be withdrawn from either of opposing sides and is further able to be drawn over the automobile to the supporting surface at both opposing sides.

19 Claims, 11 Drawing Sheets

Related U.S. Application Data application No. PCT/US2016/037058, filed on Jun. 10, 2016, which is a continuation of application No. 14/960,404, filed on Dec. 6, 2015, now Pat. No. 9,765,545.

(51) Int. Cl.

| | |
|---|---|
| ***E04H 15/48*** | (2006.01) |
| ***E04H 15/54*** | (2006.01) |
| ***E04H 15/46*** | (2006.01) |
| ***E04H 6/02*** | (2006.01) |

(56) References Cited

U.S. PATENT DOCUMENTS

| | | | | |
|---|---|---|---|---|
| 3,171,417 | A | 3/1965 | Stokes | |
| 3,399,686 | A * | 9/1968 | Horton | E04H 6/04 135/132 |
| 3,688,787 | A * | 9/1972 | Feather | B60J 7/062 135/129 |
| 4,262,460 | A | 4/1981 | Bertin | |
| 4,682,618 | A * | 7/1987 | Zwick | B60P 3/341 135/119 |
| 4,886,083 | A | 12/1989 | Gamache | |
| 5,005,896 | A * | 4/1991 | Li | B60J 7/062 135/129 |
| 5,538,313 | A * | 7/1996 | Henning | B60J 7/065 296/100.12 |
| 5,740,826 | A | 4/1998 | Nevin | |
| 6,109,283 | A | 8/2000 | Burke | |
| 6,109,298 | A | 8/2000 | Kaneko et al. | |
| 6,257,260 | B1 | 7/2001 | Phillips | |
| 6,763,842 | B2 * | 7/2004 | Blount | E04H 6/04 135/131 |
| 8,267,106 | B2 * | 9/2012 | Jordache | E04H 15/36 135/129 |
| 8,359,994 | B1 | 1/2013 | Highfield | |
| 9,033,393 | B2 * | 5/2015 | Damsi | B60J 7/022 296/100.12 |
| 9,404,281 | B1 * | 8/2016 | Donnay | E04H 15/36 |
| 9,744,834 | B2 * | 8/2017 | Damsi | B60J 7/022 |
| 9,765,545 | B1 | 9/2017 | Petrenko | |
| 2002/0093216 | A1 * | 7/2002 | Ananian | B60J 7/062 296/100.12 |
| 2007/0080557 | A1 * | 4/2007 | Knepper | B60J 7/02 296/105 |
| 2008/0210284 | A1 | 9/2008 | Dubois | |
| 2010/0200035 | A1 | 8/2010 | Jordache | |
| 2012/0048320 | A1 | 3/2012 | Hardie | |

OTHER PUBLICATIONS

USPTO; Non-Final Office Action in the U.S. Appl. No. 16/001,675 dated Jun. 26, 2018.

* cited by examiner

LATCHING MECHANISM FOR RETRACTABLE SHELTERS

CROSS-REFERENCE TO RELATED APPLICATIONS

This application is a continuation-in-part of Ser. No. 16/001,675 entitled "RETRACTABLE SHELTER" filed on Jun. 6, 2018. Ser. No. 16/001,675 is a continuation of PCT/US2016/037058 entitled "RETRACTABLE SHELTER" filed on Jun. 10, 2016. PCT/US2016/037058 claims priority to, and the benefit of, U.S. patent application Ser. No. 14/960,404 entitled "RETRACTABLE SHELTER" filed on Dec. 6, 2015 and patented as U.S. Pat. No. 9,765,545 on Sep. 19, 2017. Each of the aforementioned applications is incorporated herein by reference in their entirety for all purposes.

FIELD

The field of this disclosure is adjustable shelters especially for automobiles and other objects and particularly a shelter that has a manually retractable canopy, supported by frames which are movable along tracks so that the canopy does not touch the object stored within.

BACKGROUND

The prior art discloses a wide range of inventive shelters of the type described in the field of this disclosure. Of particular interest is a retractable motor vehicle shelter described in application publication 2010/0200035 of inventors Jordache et al. This shelter provides opposing parallel tracks in which arched poles move to support a canopy. This device is quite complex and uses a motor for automated actuation. A similar device described in application publication 2012/0048320 may be manual or motor driven and uses cylindrical bases for arched ribs supporting a cover. The bases move within hollows in tracks. One drawback of this approach is that the ribs can easily rub against the sides of the tracks causing wear and generating wear-debris.

Other frame supported tent-like enclosures are known in the prior art, but all of the prior art devices are either too flimsy so as to be subject to breakdown and jamming of moving parts, or too complex so that they are too expensive for broad commercial acceptance and also subject to high maintenance costs due to their large number of moving parts.

In contrast to the prior art apparatus, the presently described and illustrated apparatus is structurally robust and uses a new approach in holding and moving supporting canopy frames so that jamming in tracks is not possible, wear is negligible, and manual operation is easily performed as the covering canopy is opened and closed. Furthermore, the design of the disclosed apparatus is relatively inexpensive to produce making it highly attractive commercially.

SUMMARY

A presently described shelter for automobile or other objects uses a pair of spaced apart tracks which rest on a supporting surface such as the floor of a garage or car-port. A plurality of frames each having a u-shaped contour extend over the automobile but are spaced apart from it. The bottom ends of the frames are engaged with trucks which are in rolling engagement within the tracks. A canopy of a flexible material is attached to the frames and is movable between a folded state and an unfolded state in accordance with movement of the trucks and frames. The tracks have mutually orthogonal roller contact surfaces and the trucks have mutually orthogonal rollers positioned for rolling on the roller contact surfaces of the tracks. The canopy is able to be withdrawn from either of opposing ends of the tracks and is further able to be drawn over the automobile to fully enclose it. Ends of the canopy may be lifted to gain access to the engine or truck compartments of the automobile. The canopy may be drawn back to gain access to the driver and passenger compartments. Although similar devices have been conceived a problem has always been that the frames securing the canopy tend to bind in their tracks. Furthermore, prior art concepts tend to be over-engineered with complex mechanism for moving their canopy and other actuations which makes most prior art devices and apparatus too expensive to produce and too subject to breakdown or failure. The presently described shelter uses novel trucks which are inexpensive to produce and easily operated in a smooth manner.

These and other aspects of embodiments herein described will be better appreciated when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

In this document, the terms "a" or "an" are used, as is common in patent documents, to include one or more than one. Furthermore, the term "or" is used to refer to a nonexclusive "or," such that "A or B" includes "A but not B," "B but not A," and "A and B," unless otherwise indicated.

BRIEF DESCRIPTION OF THE DRAWINGS

Embodiments of the described apparatus are illustrated only as examples in the figures of the accompanying drawing sheets wherein the same reference numeral refers to the same element as it may appear in multiple figures and multiple drawing sheets.

DETAILED DESCRIPTION

As shown in the figures, this disclosure describes a shelter 10 which may be used for sheltering an automobile or other object 20. Shelter 10 may rest on a supporting surface 30 (FIG. 1) which may be a garage floor surface, a car-port surface, or any other reasonably flat surface capable of supporting the weight of shelter 10 and object 20.

Figure 1:
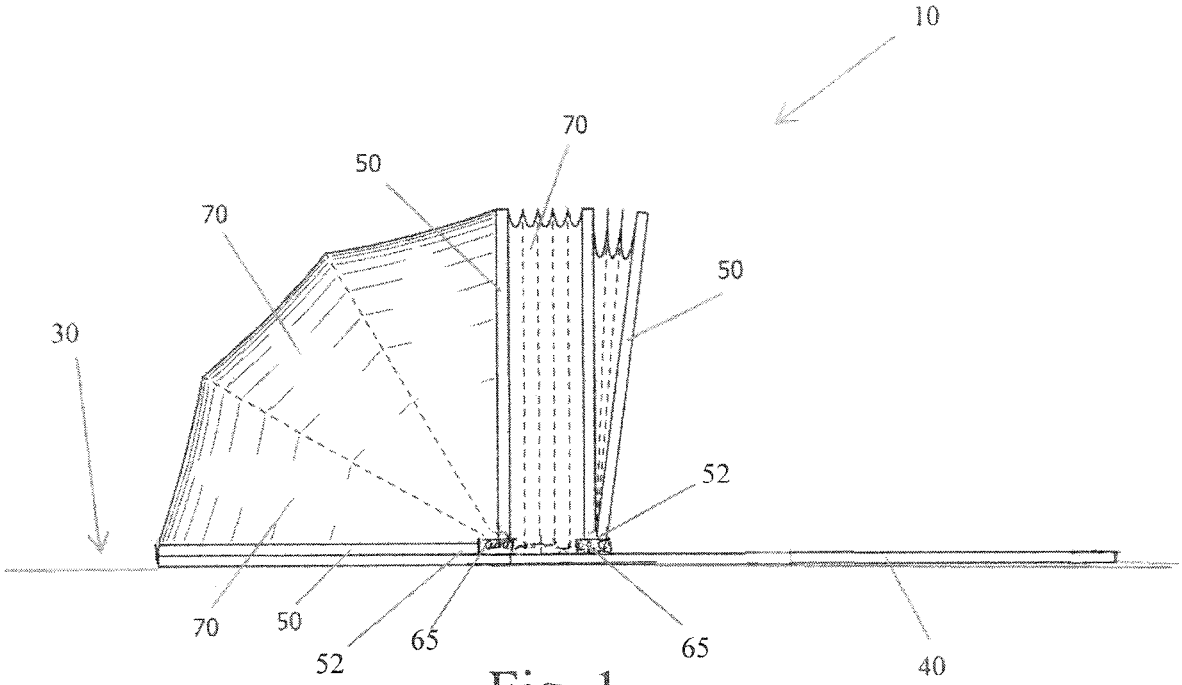
FIG. 1 is a side elevation view of an embodiment of a disclosed shelter showing an open canopy.
Figure 5:
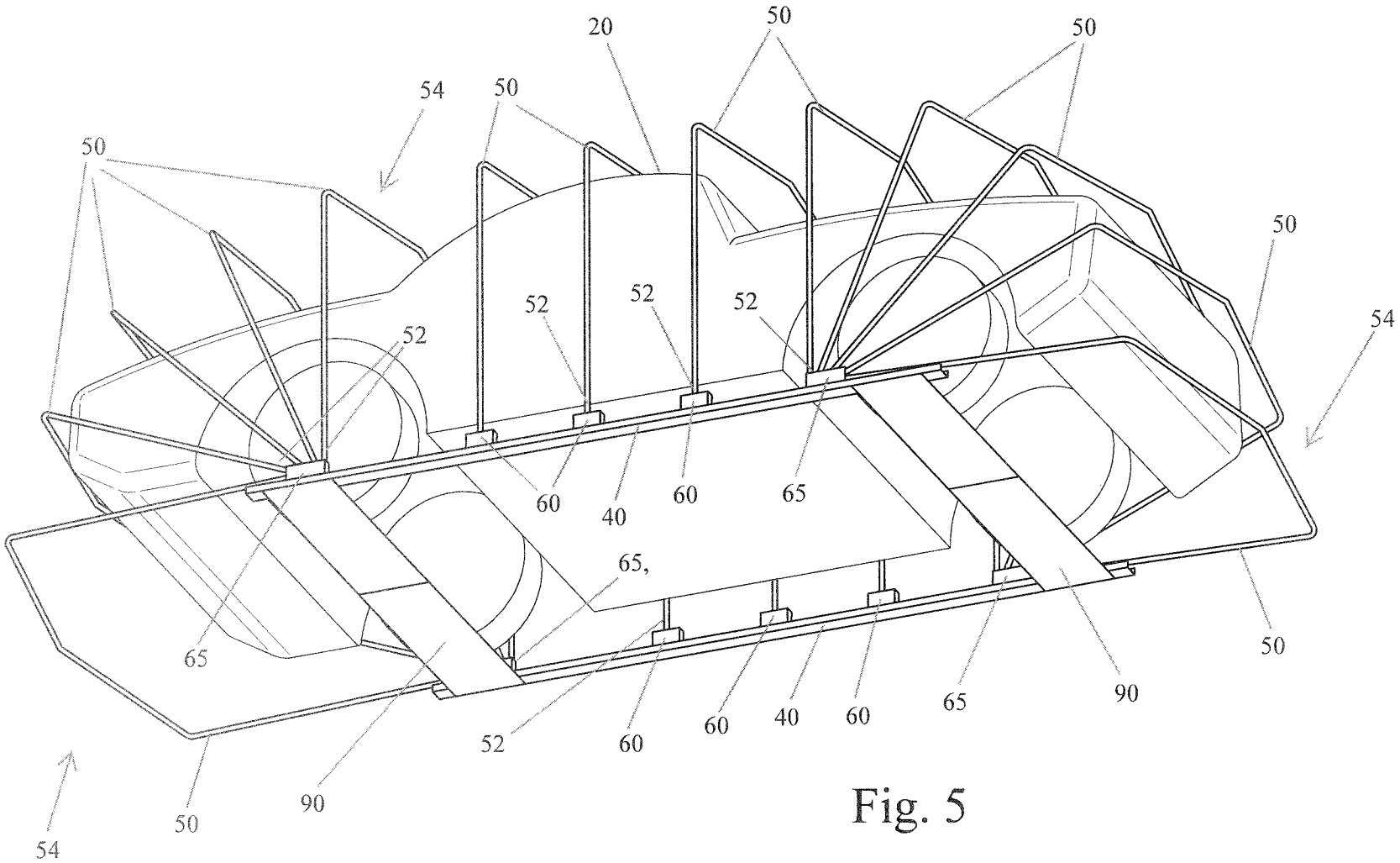
FIG. 5 is a perspective view thereof viewed from below with frames in position to support the canopy (not shown) as in FIG. 4; an automobile is depicted within.

Referring to FIG. 5 it is shown that a pair of tracks 40 are positioned on opposing sides of object 20, and as shown in FIG. 1, tracks 40 rest on surface 30 and may be fastened thereto using common fasteners. A plurality of frames 50 may have a u-shaped contour 54 and may extend over object 20 terminating on opposing sides at tracks 40. Frames 50 may be spaced apart from object 20 as clearly shown in FIG. 5.

Figure 2:
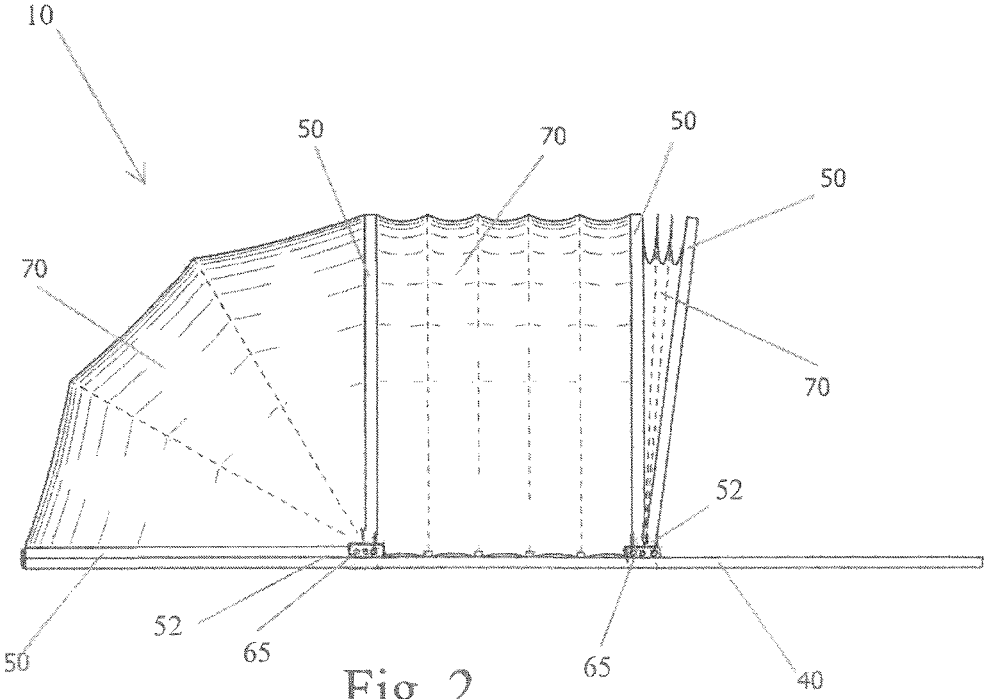
FIG. 2 is a side elevation view thereof with its canopy partially closed.
Figure 3:
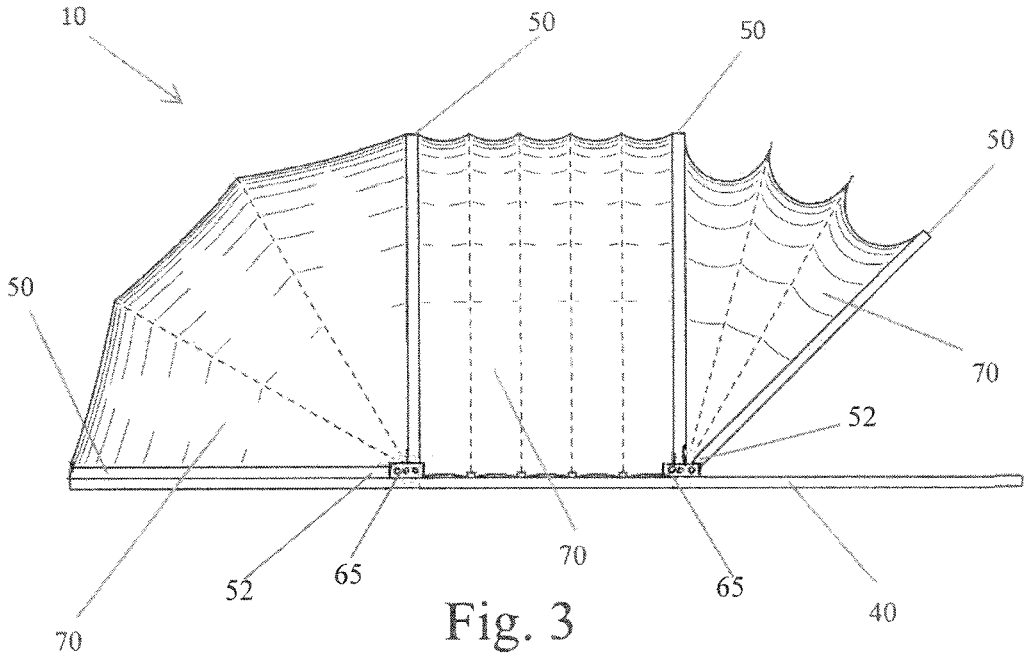
FIG. 3 is a side elevation view thereof shown with its canopy mostly closed.
Figure 4:
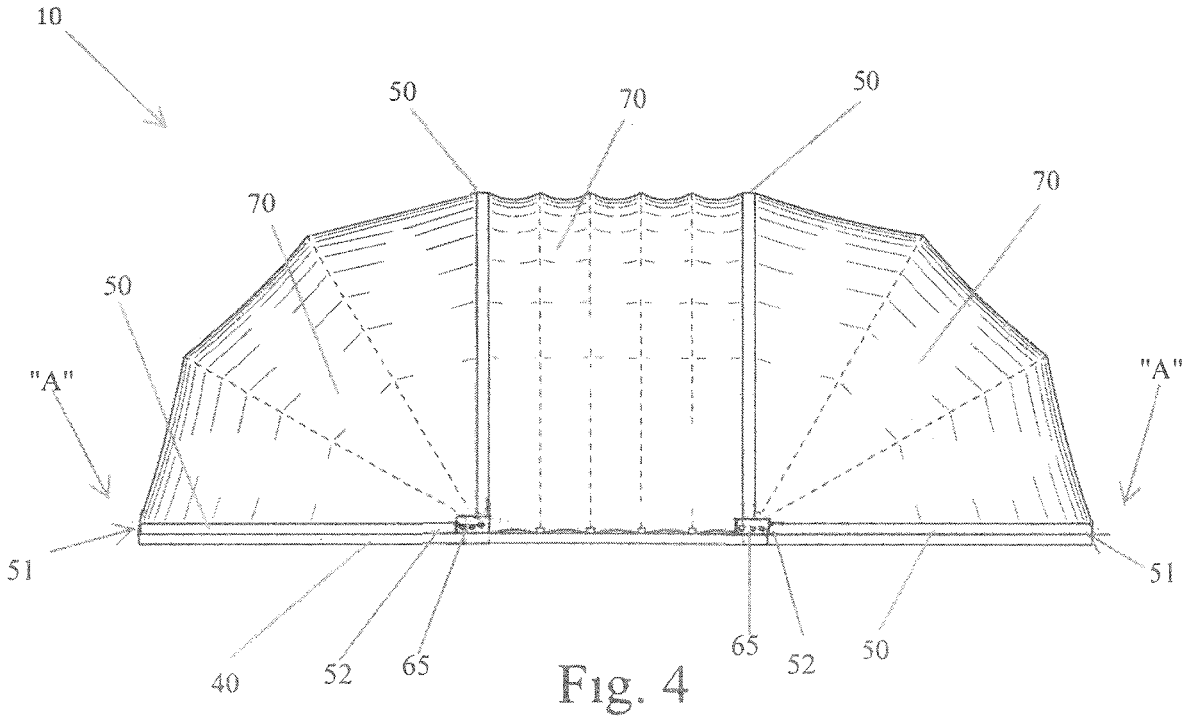
FIG. 4 is a side elevation view thereof shown with its canopy fully closed.

Terminal ends 52 of frames 50 may be engaged with trucks 60 and 65 (FIGS. 8 and 9) wherein trucks 60 and 65 may be engaged with tracks 40 as shown in FIG. 5. Canopy 70 may be of a flexible material such as a canvas fabric and may be attached to frames 50 as shown in FIGS. 1-4, such attachment being by straps of hook and loop material (not shown), or my any other means as known in the art. Canopy 70 together with frames 50 and trucks 60 and 65 may travel between a folded state as shown in FIG. 1, a semi-unfolded state as shown in FIG. 2 and a fully unfolded state as shown in FIGS. 3 and 4. Also, the left side end of canopy 70 (FIG. 1) may be opened to the extend shown in FIG. 2 for the right side end so that only the relatively small extent of canopy 70 shown at the center in FIG. 1 may be left in positioned over object 20 providing maximal access to object 20. The embodiment shown in FIGS. 1-4 teaches that some of frames 50 may be positioned within canopy 70, at the center, while others may be positioned external to canopy 70 such as shown at the left and right side ends. In a preferred embodiment canopy 70 may fully cover all frames 50 as is clear from FIGS. 1-5. In these figures some of frames 50 are depicted by dashed lines and the dashed lines at the left and right ends of canopy 70 represent frames external to canopy 70 while the frames represented by dashed lines at the center section of canopy 70 represent frames 50 within and under canopy 70. FIGS. 1-4 are not intended to represent the dimensions of frames 50 such as their cross-sectional width or diameter, but rather only their approximate overall physical size, and as such, frames 50 may be of any cross-sectional shape, and each one may be one integral piece, or may be made up of several pieces joined together such as is well known with tent poles for instance.

In various embodiments, a canopy such as canopy 70 may be one of a fabric material comprising natural and/or synthetic fibers. A canopy may comprise a plurality of fabric material layers. In various embodiments, the fabric material may comprise one of acrylic, polyester, nylon, aramaid, para-armaid such as that sold commercially as Kevlar®, polyethylene, polytetrafluoroethylene such as that sold commercially as Gore-Tex®, or ultra-high-molecular-weight polyethylene such as that sold commercially as Dyneema® and Spectra®, In various embodiments, the fabric material may be heat sealable or may be solution dyed or solution treated to improve mechanical properties such as, for example, fungus, mildew, and/or mold resistance, water resistance, breathability, wear resistance, ultra-violet radiation resistance, abrasion resistance and/or the like. The fabric material may be treated by resin impregnation or resin dip of one of a fluorocarbon, urethane, and/or acrylic between. In various embodiments the fabric material may be between 45% and 100% resin dip.

In various embodiments the fabric material may be woven with a plain weave, a lock stich weave, and/or the like. The fabric material may have a left to right selvedge. In various embodiments, the fabric material may have a weight between about 1.5 oz/sq-yard to about 20 oz/sq-yd or may between about 7 oz/sq-yd to 12 oz/sq-yd where about in this context means ±1 oz. The fabric material may have a tear strength between about 5 lbf to 40 lbf or may be between about 10 lbf to 20 lbf where about in this context means ±3 lbf. The fabric material may have a break strength between about 100 lbf to 350 lbf or may be between about 180 lbf to 285 lbf where about in this context means ±20 lbf. The fabric material may have a taber stiffness between about 10.0 to 13.0 where about in this context means ±3.0.

Figure 6:
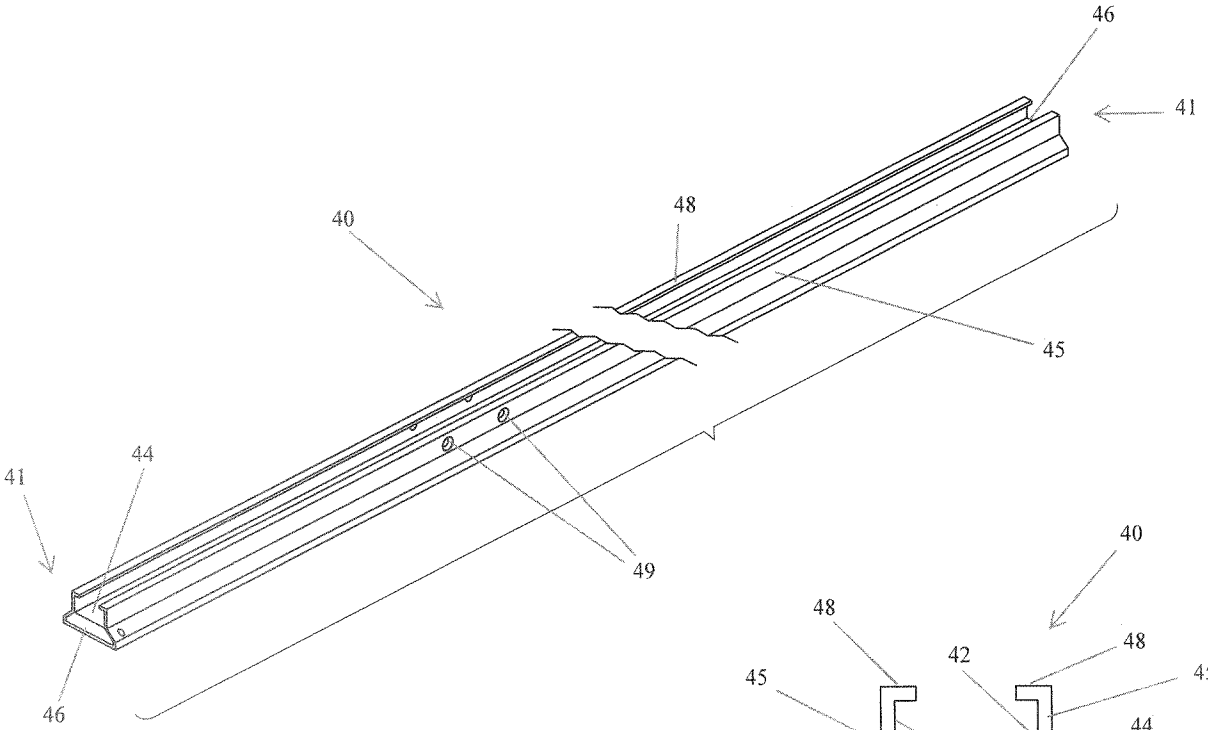
FIG. 6 is a perspective view of a track thereof shown foreshortened.
Figure 7:
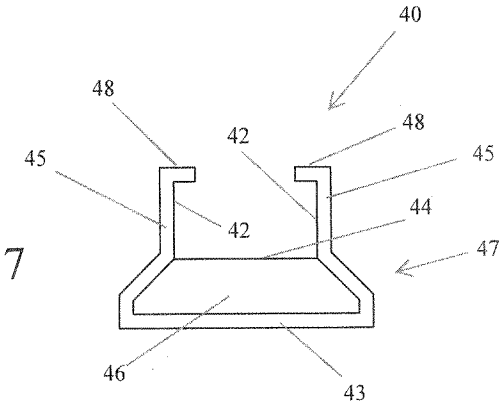
FIG. 7 is an end view of the track of FIG. 6.

Referring to FIGS. 6 and 7 it is shown that in an embodiment, tracks 40 may have a pair of spaced apart longitudinally extensive vertical side walls 45 with opposing interior roller contact surfaces 42 wherein side walls 45 may be joined by a longitudinally extensive horizontal base wall 43. Tracks 40 may be made of extruded steel, aluminum, plastic or other structural materials so that they are longitudinally straight, end-to-end. Tracks 40 may have a trapezoidal base portion 47 as shown. An insert 46 may be placed within track 40 along base portion 47 as shown and may extend its full length as shown in FIG. 6. Track 40 may be made-up of two or more separate pieces laid end-to-end, wherein insert 46 may provide a means for assuring proper joining of the separate pieces. Insert 46 may be shaped as in FIG. 7 so as to fit with friction securement within track 40.

Figure 8:
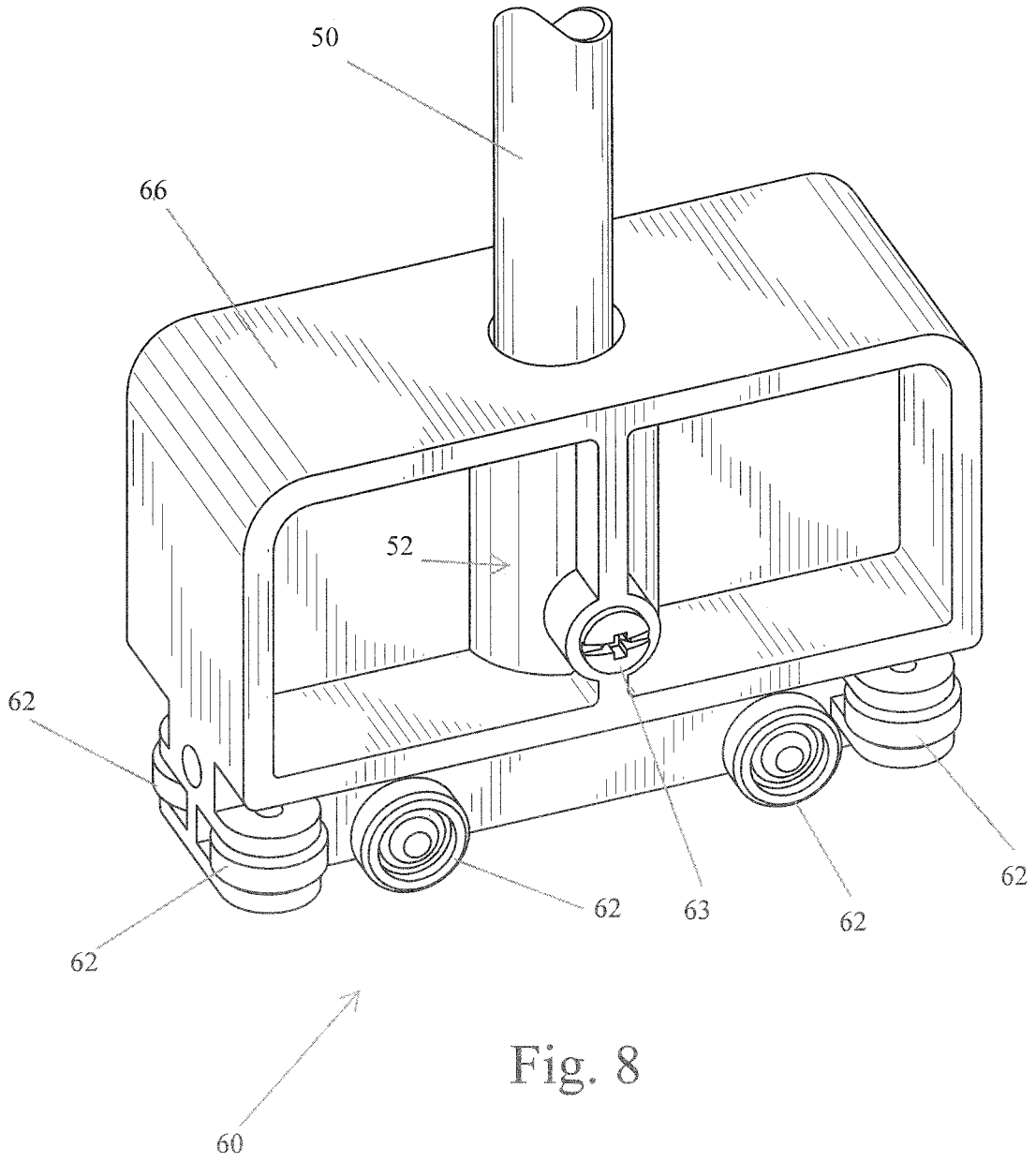
FIG. 8 is a perspective view of a truck of the shelter shown with an end of a frame mounted therein.
Figure 9:
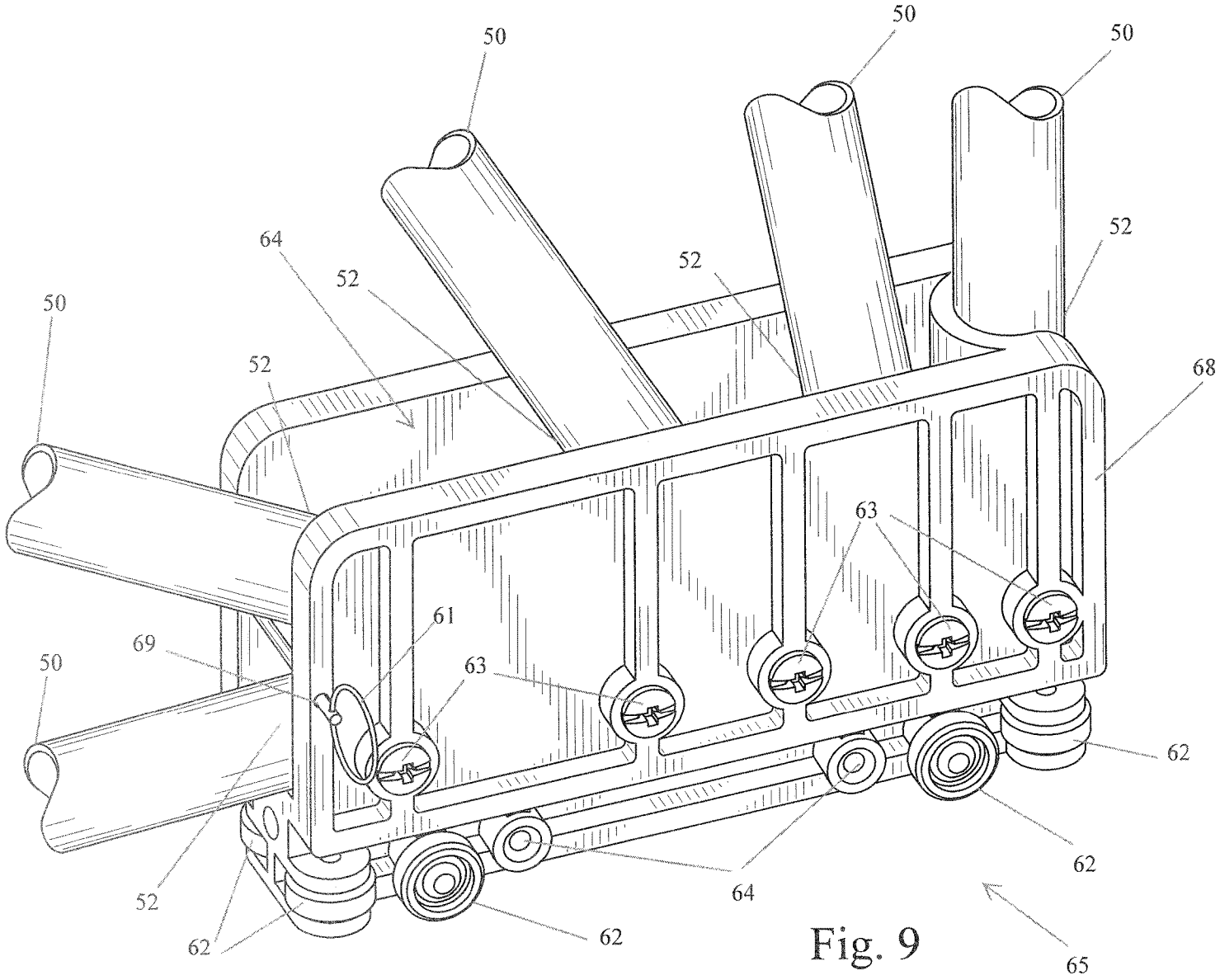
FIG. 9 is a perspective view of a further truck of the shelter shown with ends of a plurality of frames mounted therein.

Trucks 60 and 65, as shown in FIGS. 8 and 9 respectively, may have mutually orthogonal wheels or rollers 62 as shown, which may be positioned and oriented for rolling on roller contact surfaces 42 of insert 46 and roller contact surface 44 when trucks 60 and 65 are inserted into tracks 40. Trucks 60 and 65 have rigid bodies 66 and 68 respectively with rollers 62 being mounted for freely rotating. Bodies 66 and 68 may each have four of rollers 62 oriented vertically and four of rollers 62 oriented horizontally, that is, mutually orthogonal. Of course more than eight rollers 62 may be used with each truck 60, 65. Vertical rollers 62 may extend laterally from opposing sides of bodies 66 and 68 so that when trucks 60 and 65 are engaged within tracks 40, vertical rollers 62 may be positioned below flanges 48 (FIG. 7). Therefore, it may be seen that vertical rollers 62 operate in the vertical space between the undersurfaces of flanges 48 and contact surface 44 and a relatively small tolerance may be allowed in this vertical space so that vertical rollers 62 have space to freely rotate but can prevent trucks 60, 65 from tilting or canting. Furthermore, it can be seen that trucks 60 and 65 can be removed from tracks 40 only at its ends 41 (FIG. 6).

It may be desired to fix trucks 65 at selected positions on track 40, as for instance, so that the top bridging portions 51 of frames 50, when they are laid horizontally, see arrows "A" in FIG. 4, terminate at the end of tracks 40. To accomplish this, holes 49 in tracks 40 may be located longitudinally so that trucks 65 are able to be pinned in place at that location. Trucks 65 have transverse holes 64 which are spaced apart horizontally and located vertically to coincide with holes 49. Pins 61, as for instance of the type shown in FIG. 9, may be used to accomplish securement of trucks 65 in this manner on tracks 40.

As shown in FIG. 9, pin 61 may be placed through holes 69 of body 68 to prevent frame 50 which has been placed into a horizontal attitude, see arrow "A" in FIG. 4, from being lifted or raised by wind forces, for example thereby securing canopy 70 to fully cover object 20. Pin 61 may be removed to allow canopy 70 to be raised, as shown in FIG. 3 in order to gain access to object 20 at one or the other ends of canopy 70. Therefore, when raising or lowering canopy 70 at its ends, trucks 65 may be secured so as to be unable to move on track 40.

Horizontal rollers 62 may be spaced-apart into near contact with both roller contact surfaces 42 so that trucks 60 and 65 are maintained in central positions within tracks 40. Therefore, trucks 60 and 65 are able to easily roll longitudinally within tracks 40. As each pair of trucks 60 move within tracks 40 their connected frame 50 moves with them and maintains its vertical posture as shown in FIGS. 1 and 2. The connecting frames 50 move with trucks 60 and 65 and are able to maintain their near vertical posture as shown in FIGS. 1 and 2 and also are able to rotate away from the vertical as shown in FIGS. 3 and 4. When one truck 60 or 65 is forced to progress along track 40 ahead or behind its truck pair, horizontal rollers 62 tend to take up this distortion preventing binding of the trucks with track 40. Because rollers 62 are in contact with track 40 binding between truck 60, 65 and track 40 is prevented even when strong distorting forces are applied to frames 50. During normal manual opening and closing of canopy 70 smooth operation is experienced.

As shown in FIG. 5 a compliment of trucks may include pairs of first trucks 60 and pairs of second trucks 65, the pairs engaged with opposing tracks 40. Each pair of first trucks 60 may be engaged with a single one of frames 50 which is fixed in a vertical orientation, see FIG. 8. Each pair of second trucks 65 may be engaged with plural frames 50 in a hinged manner as hinge rods 63 extend through the lower portions 52 of frames 50, thereby allowing rotation over a range of angles positioning frames 50 from near vertical to fully horizontal, as shown in FIG. 5. To accomplish this, truck 65 has an open structure referenced by numeral 64.

Tracks 40 may be joined by a transverse element 90 securing tracks 40 in mutually parallel positions as shown in FIG. 5 so that the lower legs of frames 50 on opposing tracks 40 do not converge or diverge as trucks 60 and 65 move along tracks 40. Transverse element 90 may be fastened to tracks 40 using common hardware and may be any rigid element but preferably in the form of a strip, or a rod for instance.

In an embodiment, object 20 may be a vehicle such as an automobile as shown in FIG. 5 wherein frames 50 and canopy 70 are spaced apart from the vehicle so as not to scratch it. Object 20, may be anything that one desires to shelter from dust, sand, dirt, the outdoor elements, and so on, but shelter 10 is ideal for sheltering an automobile as it allows flexibility in gaining access to both ends of canopy 70 and allows nearly full withdrawal as well so as to gain maximum access to sheltered object 20.

Figure 10:
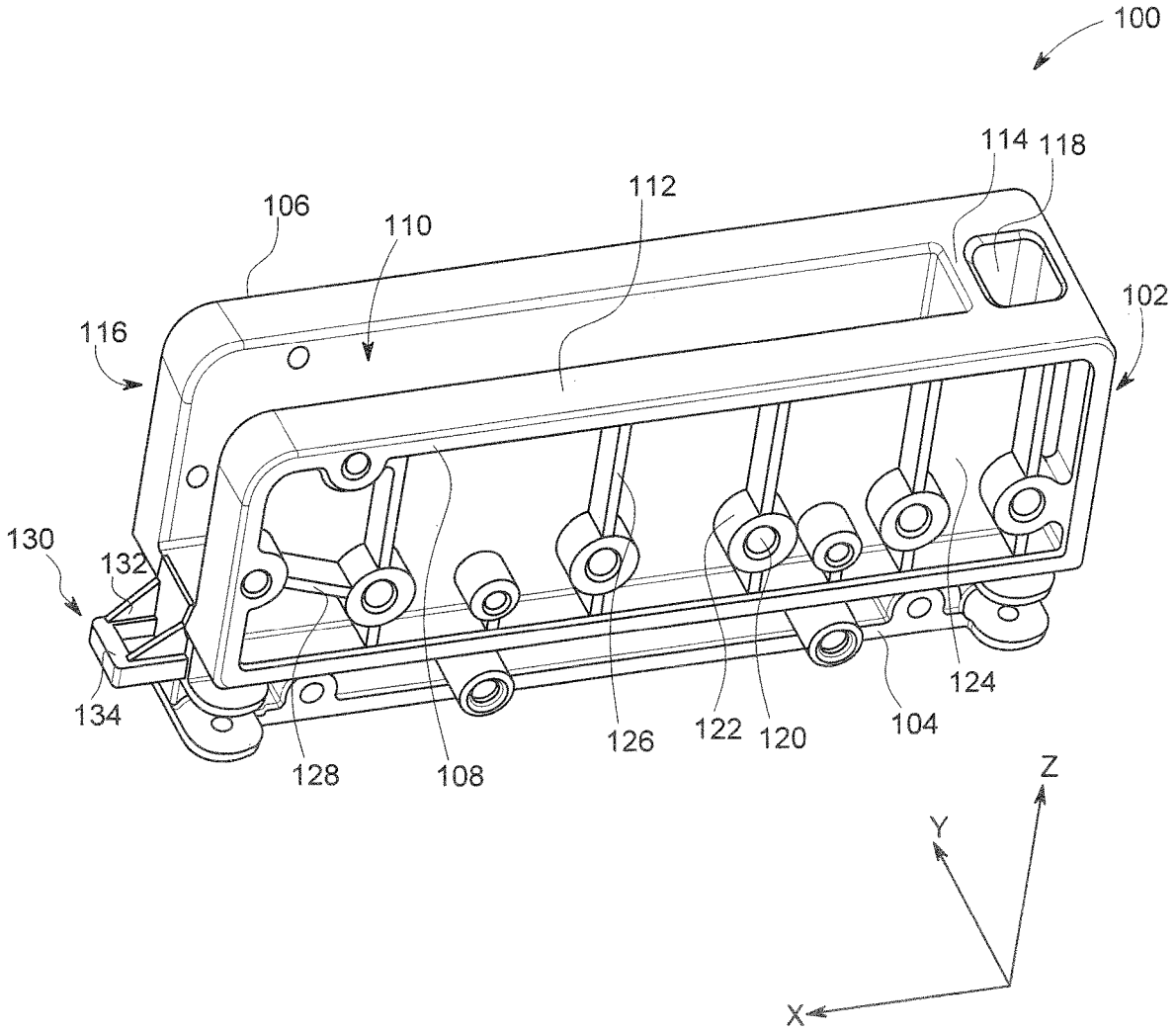
FIG. 10 illustrates another truck, in accordance with various embodiments.

With additional reference to FIG. 10, a truck 100 is illustrated in accordance with various embodiments and with XYZ-axes provided for reference. Truck 100 comprises features, geometries, construction, manufacturing techniques, and/or internal components similar to first truck 60 and second truck 65. Truck 100 comprises a generally rectangular body 102 having a base portion 104, a first sidewall 106, and an opposing second sidewall 108 extending orthogonal (along the Z axis) to base portion 104 defining a channel 110 therebetween. Channel 110 is open at a top surface 112 of the body 102 extends longitudinally (along the X-axis) with respect to the base portion 104 through forward face 116 of body 102 and terminates at a transverse endwall 114. A cavity 118 proximate endwall 114 extends from the top surface 112 into body 102 toward the base portion (along the Z-axis).

In various embodiments, base portion 104 comprises a hitch 130. In various embodiments, hitch 130 may be located at a forward face 116 of the body 102. The hitch 130 may be relatively U-shaped. In various embodiments, a hitch may comprise any suitable shape configured to interface with a latch of a latching mechanism and facilitate a coupling between the hitch and the latch mechanism. In an exemplary embodiment, hitch 130 may comprise a strike face 134. Strike face 134 may be configured to contact a latch of a latch mechanism and guide the latch to interface with a coupling portion of the hitch 130. In an exemplary, embodiment, hitch 130 may comprise buttresses 132 extending over the 'arms' of the U toward the strike face 134 of the hitch 130. In this regard, buttresses 132 may tend to resist bending loads (along the Z-axis) or torque (about the X-axis) applied at strike face 134.

In various embodiments, first sidewall 106 and second sidewall 108 comprise a plurality of coaxially transverse passages 120. Sidewalls 106 and 108 may include a plurality of recessed areas 124 inset into body 102 (along the Y-axis) and each of passages 120 may be defined by an annular wall 122 extending from the recessed areas 124. In various embodiments, a plurality of ribs 126 may extend from the annular walls 122. The plurality of ribs 125 may extend over the recessed areas 124 defined between the top surface 112 and the base portion 104. In various embodiments, a rib such as rib 128 may extend between annular walls 122. In various embodiments, a rib may extend between an annular wall and an edge of the recessed areas 124. In various embodiments, each of the cavity and the channel may have an identical depth as measured from the top surface to the base portion (along the Z-axis). In various embodiments, the cavity 118 may comprise a chamfered mouth and have a substantially rectilinear circumference.

Figure 11A:
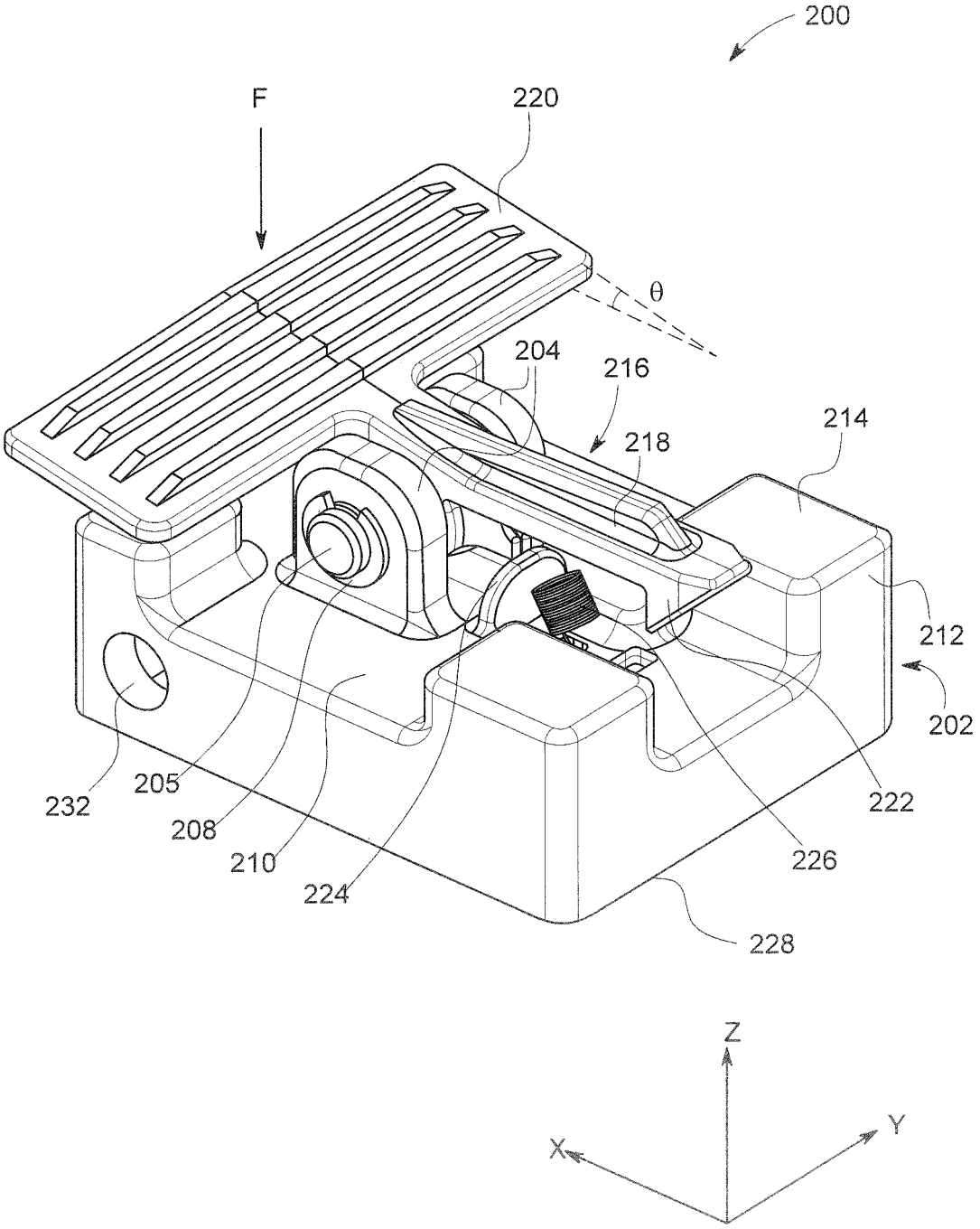
FIG. 11A illustrates a perspective view of a truck latching mechanism, in accordance with various embodiments.

With additional reference to FIG. 11A, a truck latching mechanism 200 is illustrated in accordance with various embodiments with XYZ-axes provided for reference. In an exemplary embodiment, truck latching mechanism 200 comprises a rectangular base 202 having axle supports 204 coupled at top surface 210 of the rectangular base 202. In an exemplary embodiment, axle 205 is coupled through axle supports 204 and retained transversely (along the Y-axis) within the supports 204 by a retaining clip 208. In an exemplary embodiment, rectangular extrusions 212 extend from top surface 210 proximate each corner of rectangular base 202. In an exemplary embodiment, each of the rectangular extrusions 212 comprise an upper interference surface 214. In an exemplary embodiment, latch 216 is coupled to axle 205 and configured to pivot thereabout. In an exemplary embodiment, latch 216 comprises a latch arm 218 coupled to a footplate 220 and a catch 222. In an exemplary embodiment, footplate 220 is coupled proximate the axle 205. In an exemplary embodiment, the catch 222 is coupled at a distal end of the latch arm 218 opposite the footplate 220 and axle 205. In an exemplary embodiment, latch arm 218 rests relatively parallel to top surface 210 on a stop 224 which extends from the top surface 210 of the rectangular base 202. In an exemplary embodiment, a return spring 226 is coupled between the rectangular base and the latch arm 218. In an exemplary embodiment, footplate 220 is coupled at an angle θ relative to the latch arm. In various embodiments angle θ is between 5° and 45°. In this regard, in response to a relatively downward (along the Z-axis) force F applied at footplate 220, latch arm 218 rotates through the angle θ about the axle 205 thereby raising catch 222 upward and away (Z-axis) from top surface 210 and bringing footplate 220 into contact with rail 40. In response to the downward force F, return spring 226 generates a return force R at the latch arm 218 tending to resist the downward force F and tending to return the latch arm 218 into contact with the stop 224.

Figure 11B:
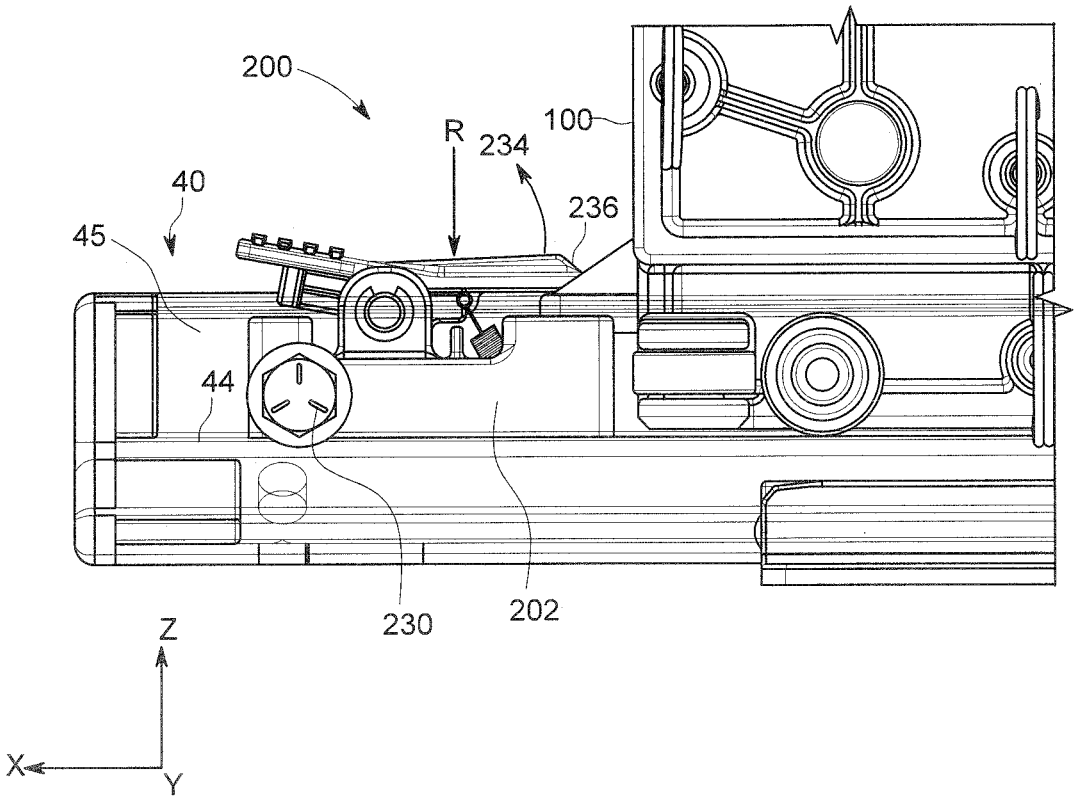
FIG. 11B illustrates a truck latching mechanism in a locked state, in accordance with various embodiments.

In various embodiments and with additional reference to FIG. 11B, latch mechanism 200 is shown inserted into a track such as track 40 which is illustrated as translucent for clarity. Bottom surface 228 of rectangular base 202 rests on contact surface 44 with interference surfaces 214 disposed proximate flanges 48 and an interference between the interference surfaces 214 and the flanges 48 retain the rectangular base 202 within the track 40 with respect to the Z axis. A fastener 230 is disposed transverse through fastener hole 232 of rectangular base 202 and through side walls 45 thereby tending to inhibit latch mechanism 200 from translating along the X-axis within track 40. In an unlatched state, truck 100 may translate along the X-axis toward, or away from, latch mechanism 200. In response to the translation of truck 100 toward latch mechanism 200 strike face 134 contacts catch 222 and thereby latch arm 218 is driven upward (approximate Z-axis, relative to the track) along arrow 234 by hitch 130. In response, return spring 226 may tend to stretch thereby generating the return force R. As catch 222 passes over strike face 134, return force R draws latch arm 218 relatively toward hitch 130 and disposes catch 222 within hitch 130. In response to catch 222 being disposed within hitch 130, an interference 236 is generated tending to inhibit translation of the truck 100 along the X-axis relative to the latch mechanism 200. Stated another way, latch mechanism 200 may couple to hitch 130 and thereby tend to restrain truck 100 from axial (X-axis) translation within the track 40 transitioning truck 100 from the unlatched state to a latched state.

Figure 12A:
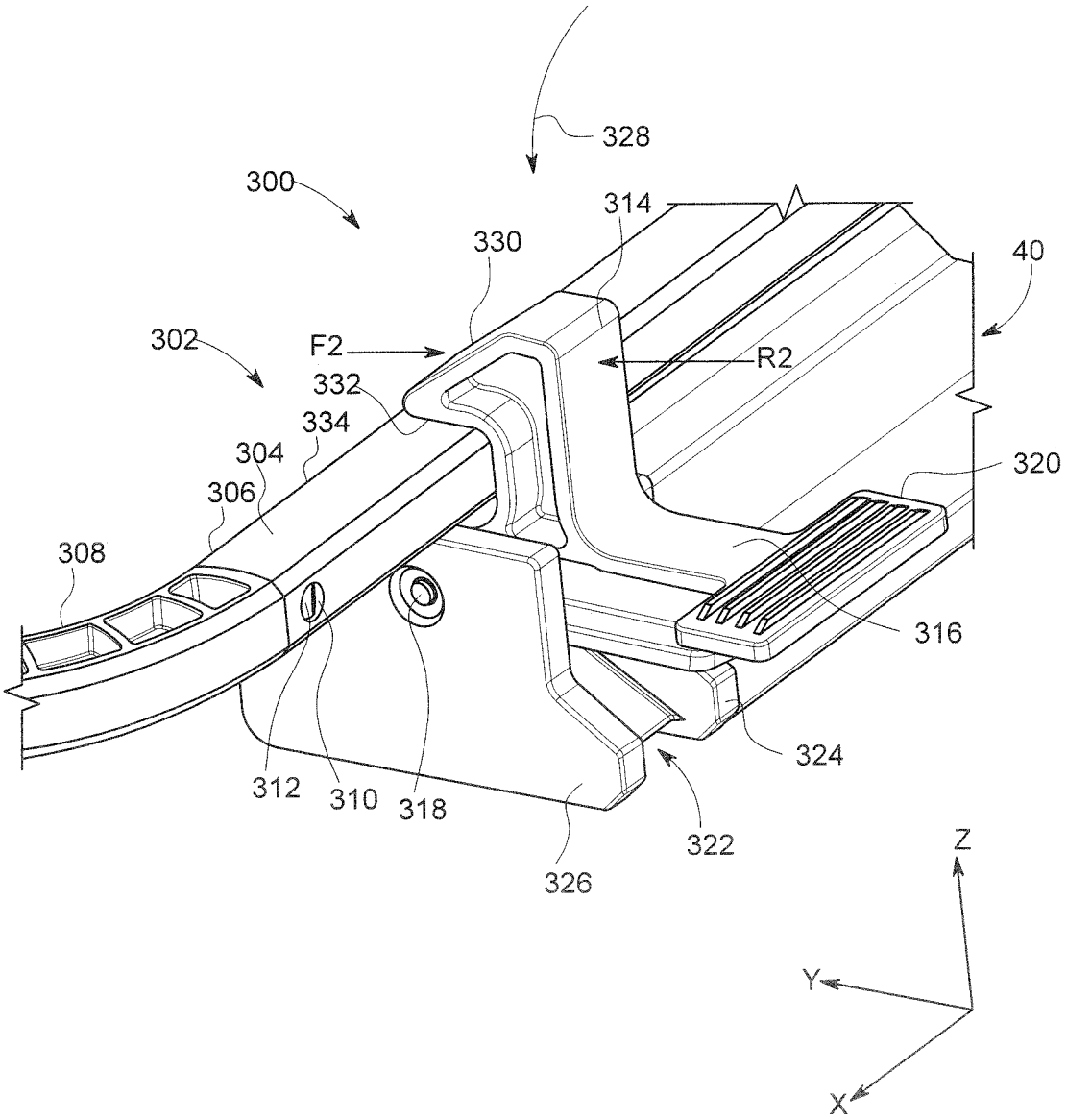
FIG. 12A illustrates a perspective view of a frame latching mechanism in a locked state, in accordance with various embodiments.
Figure 12B:
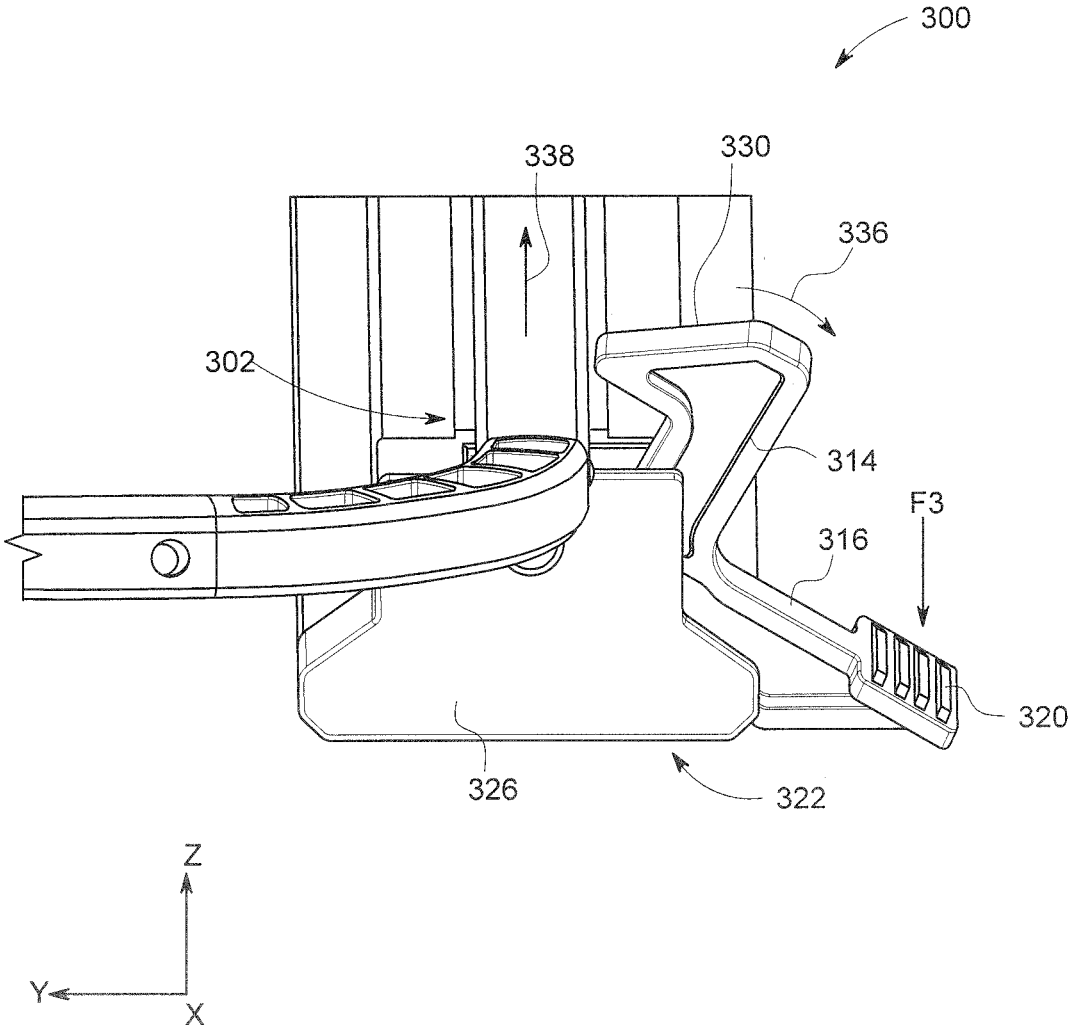
FIG. 12B illustrates a perspective view of a frame latching mechanism in an unlocked state, in accordance with various embodiments.

In various embodiments and with additional reference to FIGS. 12A and 12B, a latching mechanism 300 for a frame 302 is illustrated with XYZ-axes provided for reference. Frame 302 comprises features, geometries, construction, manufacturing techniques, and/or internal components similar to frame 50. Frame 302 comprises a first metallic extrusion 304 coupled at first end to a truck such as, for example, one of truck 100, truck 60, and/or truck 65. In an unlatched state, frame 302 may freely pivot about the first end (i.e., about the Y-axis). First extrusion 304 is coupled at a second end 306 to an elbow 308 which couples the first extrusion 304 at a relatively orthogonal angle to a second extrusion. In various embodiments, the first extrusion may be an annular extrusion and the coupling between the first extrusion 304 and the elbow 308 may comprise a slip fit coupling. Elbow 308 may include a tongue having a stud 310 and the tongue may be inserted into the first extrusion 304. In response, stud 310 may be disposed within cutout 312 in first extrusion 304 generating an interference which tends to inhibit the tongue of elbow 308 from backing out of the first extrusion 304.

In an exemplary embodiment, latching mechanism 300 comprises a catch 314 coupled orthogonally to a latch arm 316. In an exemplary embodiment, latch arm 316 is coupled to an axle 318 and, at a distal end of the latch arm 316 relative to axle 318, coupled to a footplate 320. In an exemplary embodiment, catch 314 extends from latch arm 316 relatively between the axle 318 and the footplate 320. Axle 318 is aligned parallel (along the X-axis) with a track such as track 40 and coupled relatively between a first plate 324 and a second plate 326 of an endcap 322. First plate 324 is coupled to track 40 and may include a tongue configured to be inserted into track 40. Latch arm 316 is disposed between the first plate 324 and the second plate 325 relatively transverse (along the Y-axis) to track 40 and configured to pivot about the axle 318.

In various embodiments, frame 302 may be pivoted along arrow 328 about the first end of the first extrusion 304 (i.e., about the Y-axis in an arc through the ZX-plane) and contact strike face 330 of catch 314. An interference between strike face 330 and first extrusion 304 generates, in response, force F2 at strike face 330 tending to cause latch arm 316 to pivot about axle 318 and allow frame 302 to rotate through the catch 314. A return force R2 is generated in response to the force F2 which tends to drive catch 314 into contact with first extrusion 304 and tending thereby to generate an interference 332 between catch 314 and surface 334 of first extrusion 304 which retains the second end 306 of the first extrusion 304 proximate endcap 322 thereby transitioning the frame 302 from the unlatched state to a latched state. In various embodiments, a force F3 may be applied to footplate 320 and tending to cause latch arm 316 to pivot about axle 318 and, in response, catch 314 rotates along arrow 336 relatively away from frame 302. In response, interference 332 is disrupted and strike face 330 is rotated clear of the plane of travel of first extrusion 304 thereby enabling frame 302 to be lifted along arrow 338 relatively away (along the Z-axis) from endcap 322. In this regard, applying the force F3 to footplate 320 may transition the frame 302 from the locked state to an unlocked state.

In the foregoing description, embodiments are described as a plurality of individual parts, and methods as a plurality of individual steps and this is solely for the sake of illustration. Accordingly, it is contemplated that some additional parts or steps may be added, some parts or steps may be changed or omitted, and the order of the parts or steps may be re-arranged, while maintaining the sense and understanding of the apparatus and methods as claimed.

What is claimed is:

1. A shelter comprising:

a parallel pair of spaced apart tracks for resting on a supporting surface;

a first latching mechanism coupled to at least one of the spaced apart tracks;

a plurality of frames extending between the tracks, each one of said frames having opposing terminal ends;

wherein, said terminal ends of said frames are engaged with trucks, said trucks engaged with said tracks;

a canopy attached to said frames, said canopy movable between a folded state and an unfolded state in response to a translation of said trucks;

wherein said tracks each have a first contact surface and a second contact surface configured to retain said trucks within said tracks;

wherein each one of said trucks contacts the respective first contact surface and second contact surface and, in response to the contact, is configured to translate along an axis parallel to the respective track;

wherein at least one of said trucks further comprises a hitch;

wherein the first latching mechanism further comprises a latch arm coupled to an axle and configured to pivot thereabout, a footplate, and a catch;

wherein the footplate is coupled to the latch arm proximate the axle, and wherein the catch is coupled to the latch arm at a distal end of the latch arm opposite the footplate and the axle.

2. The shelter of claim 1, wherein the footplate is coupled at an angle between 5° and 45° relative to the latch arm.

3. The shelter of claim 1, wherein translating the at least one of said trucks comprising the hitch along the track toward the first latching mechanism contacts a strike face of the hitch with the catch and in response transitions the at least of said trucks comprising the hitch from an unlatched state to a latched state.

4. The shelter of claim 3, further comprising a second latching mechanism coupled to at least one of the spaced apart tracks.

5. The shelter of claim 4, wherein the second latching mechanism comprises:

a second catch coupled orthogonally to a second latch arm;

an endcap having a first plate, a second plate, and a second axle coupled between the first plate and the second plate, wherein the second latch arm is coupled to the second axle and disposed between the first plate and the second plate, wherein the second latch arm is disposed transverse to the at least one of the spaced apart tracks;

a second footplate coupled to the second latch arm at a distal end relative to the axle, wherein the second catch extends from the second latch arm relatively between the second axle and the second footplate.

6. The shelter of claim 1, wherein each one of said trucks comprises a first roller and a second roller, wherein the first roller contacts the first contact surface and the second roller contacts the second contact surface.

7. The shelter of claim 6, wherein the first contact surface and the second contact surface are mutually orthogonal.

8. The shelter of claim 6 wherein each one of said tracks has a pair of spaced apart side walls and a pair of spaced apart flanges, said side walls joined by a base wall orthogonal to said side walls.

9. The shelter of claim 8, wherein said first and second rollers roll in contact with said side and base walls of said tracks.

10. The shelter of claim 1, wherein said trucks include pairs of first trucks and pairs of second trucks, wherein each pair of first trucks are engaged with one of said plurality of frames and wherein each pair of second trucks are engaged with one of said plurality of frames.

11. The shelter of claim 10, wherein each one of said plurality of frames engaged with a pair of said first trucks is fixed in an approximately vertical orientation.

12. The shelter of claim 11, wherein each one of said plurality of frames engaged with said second trucks are rotatable over a range of angles relative to said tracks.

13. The shelter of claim 12, wherein one of said plurality of frames is rotatable between an approximately vertical orientation and an approximately horizontal orientation.

14. The shelter of claim 1, further comprising a transverse element coupled between the tracks configured to retain the tracks from translating with respect to the support surface.

15. The shelter of claim 1, wherein the canopy comprises a fabric material including at least one of acrylic, polyester, nylon, aramaid, para-armaid, polyethylene, polytetrafluoroethylene, and ultra-high-molecular-weight polyethylene.

16. The shelter of claim 15, wherein the fabric material is at least one of solution dyed, solution treated, or resin impregnation treated to between 45% and 100% resin dip.

17. A method of securing a truck comprising:

translating the truck along a track toward a latch mechanism;

contacting a strike face of a hitch of the truck with a catch coupled to a latch arm;

driving the latch arm upward relative to the track in response to the contacting and generating a return force; and drawing the latch toward the hitch in response to the return force and disposing the catch within the hitch.

18. The method of claim 17, wherein the truck transitions from an unlocked state to a locked state in response to disposing the catch within the hitch.

19. The method of claim 18, further comprising applying a force to a footplate coupled to the latch arm and, in response to the force, transitioning the truck from the locked state to the unlocked state.

* * * * *